United States Patent [19]

Hachikawa et al.

[11] 4,143,779

[45] Mar. 13, 1979

[54] CAN END FEEDER

[75] Inventors: Kazumitsu Hachikawa; Masaaki Ogawa, both of Kawaramachi, Japan

[73] Assignee: Hitachi Shipbuilding & Engineering Co. Ltd., Osaka, Japan

[21] Appl. No.: 838,586

[22] Filed: Oct. 3, 1977

[30] Foreign Application Priority Data

Oct. 5, 1976 [JP] Japan ..... 51/120067

[51] Int. Cl.[2] ..... B65G 65/40

[52] U.S. Cl. ..... 414/411; 414/421

[58] Field of Search ..... 214/300, 304, 305, 306, 214/307, 312, 314, 318, 313, 308, 1 Q

[56] References Cited

U.S. PATENT DOCUMENTS

| | | | |
|---|---|---|---|
| 2,648,298 | 8/1953 | Holbeck | 214/312 X |
| 3,300,064 | 1/1967 | Baer | 214/314 X |

FOREIGN PATENT DOCUMENTS

| | | | |
|---|---|---|---|
| 1200210 | 9/1965 | Fed. Rep. of Germany | 214/300 |
| 49-103775 | 10/1974 | Japan. | |

*Primary Examiner*—Frank E. Werner

[57] ABSTRACT

Bags each containing a stack of can ends and closed at its open end by being folded are fed one by one by a conveyor, and each bag is then delivered from the conveyor into a de-bagger case in a receiving position in which the case has its opening directed upward and the folded end is thereby unfolded. The bag within the de-bagger case is then adhered to the inner wall of the case by suction. The de-bagger case is subsequently turned to a discharge position in which the opening is directed downward, permitting the can ends within the bag to be moved downward by gravity into a transfer guide for guiding the can ends to a feeding duct for a seamer. The case is provided at its bottom with a mouth for injecting a pressure fluid into the case for forcing out the remaining empty bag from the case. The case is further provided near the outlet thereof with a can end retainer for holding the can ends in position when they move out from the bag.

8 Claims, 8 Drawing Figures

CAN END FEEDER

This invention relates to an apparatus for feeding can ends such as juice or beer can ends to a seamer, and more particularly to a can end feeder by which can ends contained in the form of a stack within a tubular bag are taken out therefrom and then transferred to a can end feeding duct for a seamer.

In feeding can ends to a seamer, the folded closed ends of tubular bags containing can ends are usually manually opened and then placed into a can end feeding chute provided for the seamer. This requires a heavy labor because can ends must be fed at a rate in conformity with the speed of the operation of the seamer. If the feed of can ends delays, there arises the necessity of interrupting the operation of the seamer and as well as of the filling machine and other machines on the processing line. It has therefore been desired to speed up the can end feeder line by automatic mechanical means.

For this purpose, various automatic feeders have been proposed in recent years, but none of them are operable at a relatively high speed repeatedly a large number of times free of any trouble i.e. with high reliability, easy to maintain and to inspect and durable for a prolonged period of use. Japanese Patent Application Disclosure No. 49-103775, for example, discloses an automatic feeder comprising conveyor means for feeding can end containing bags one by one, de-bagger means including a de-bagger case turnable between a receiving position for receiving therein the bag from the conveyor means and a discharge position in which the opening of the case is directed downward to permit the can ends to fall from the bag under gravity and bag cutting means disposed at the case opening for opening the bag, and guide means for guiding to a can end feeding duct the can ends falling from the bag within the case. However, this feeder has the problems that the bag cutting means does not function reliably when the feeder is operated for a considerable period of time and that the feeder is complex to maintain and to inspect and is not durable.

The main object of this invention is to provide a can end feeder free of the foregoing drawbacks, reliable, durable and easy to maintain and to inspect.

Another object of this invention is to provide a can end feeder which permits recovery of empty bags for reuse and which therefore ensures an economical advantage.

Another object of this invention is to provide a can end feeder including de-bagger means for taking out can ends from can end containing bags closed by a folded open end and fed with the folded portion positioned in the rear with respect to the direction of travel of the bags.

Another object of this invention is to provide a can end feeder in which the de-bagger means includes a de-bagger case turnable between a receiving position for receiving a fed bag therein and a discharge position in which the case has its opening directed downward to render the can ends within the bag downwardly movable, the case having an inside diameter greater than the outside diameter of the bag by an amount permitting the bag to smoothly enter the case, the case being provided with suction means for at least partially adhering the bag therein to its inner wall and with means for discharging the bag therefrom.

Another object of this invention is to provide a can end feeder by which the bag placed in the case can be reliably opened and longitudinally stretched free of any creases and in intimate contact with the inner surface of the case so as to render the can ends dischargeable in a proper position free of any restraint.

To fulfil this object, the present invention provides a can end feeder in which the suction means is provided near the opening and bottom of the case.

Another object of this invention is to provide a can end feeder including guide means for smoothly feeding the can ends to a seamer in an orderly arrangement free of clogging which would otherwise take place if the can ends egressing from the bag are allowed to spontaneously fall in a random position.

To fulfill this object, this invention provides a can end feeder in which the case is provided with a can end retainer for holding the bagged can ends in position within the case by contact with the bagged can end closest to the opening, the retainer being movable toward the open end of the case after the case has been brought to its discharge position and retractable sidewise after delivering the can ends to the guide means.

Various other features and advantages of this invention will become apparent from the following description of the preferred embodiments of the invention given with reference to the accompanying drawings, in which.

Figure 1:
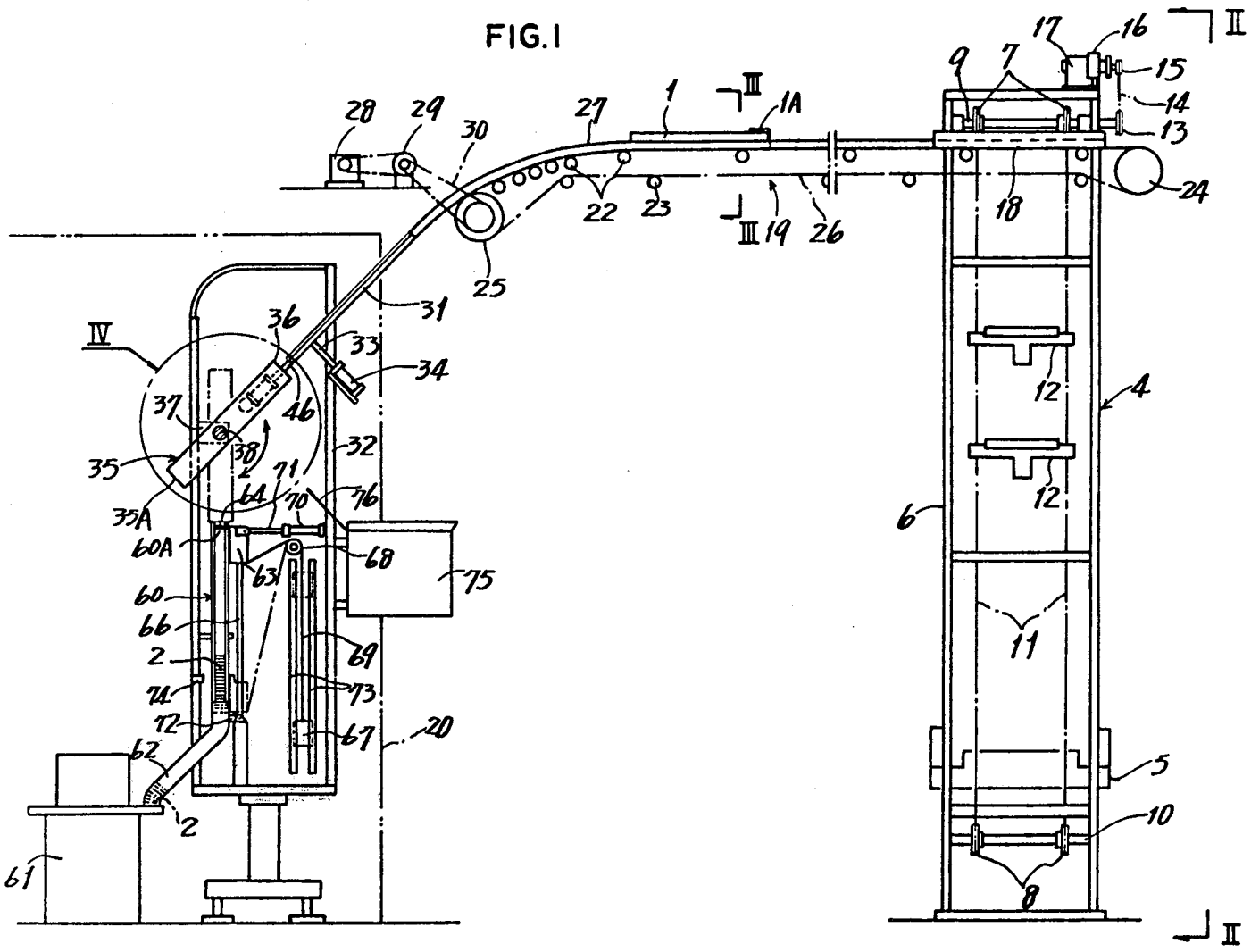
FIG. 1 is an overall front view showing a first embodiment of the can end feeder of this invention.
Figure 2:
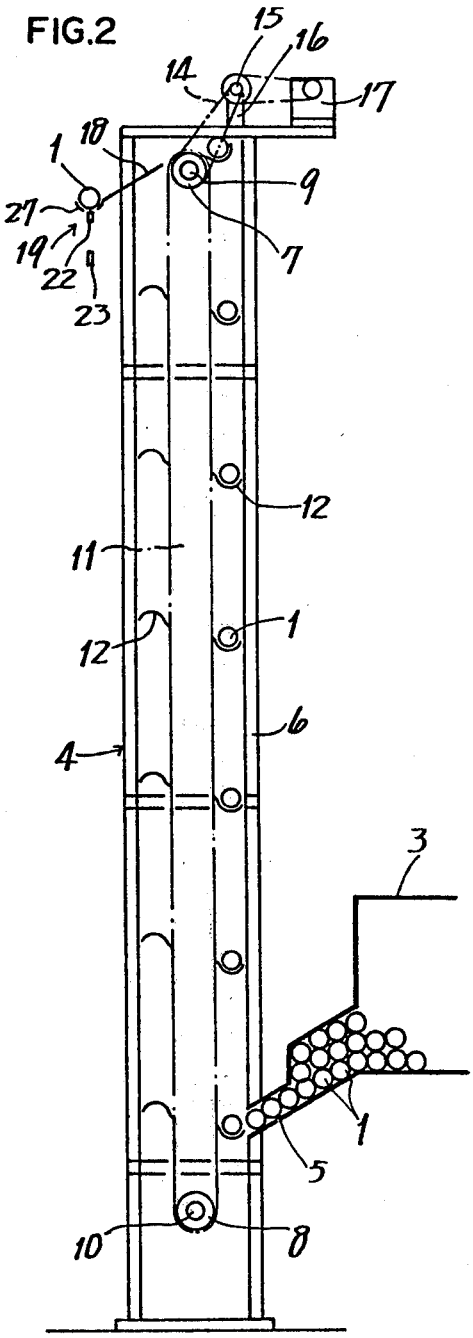
FIG. 2 is an enlarged view of the same as it is seen in the direction of the arrow line II—II in FIG. 1.

With reference to FIGS. 1 and 2, an enlongated tubular bag 1 containing a stack of tens to hundreds of can ends 2 has an open end which is closed by a folded portion 1A to retain the can ends within the bag. A plurality of these bags 1 are packaged into a group and temporarily kept in a storage. The package is separated into individual bags by a de-palletizer 3 when desired and are placed into a feeding chute 5 at a lower portion of an elevator 4 in such a position that they will travel on a conveyor (to be described later) with the folded portions 1A positioned in the rear with respect to the direction of travel. The frame 6 of the elevator 4 is provided with an upper shaft 9 and a lower shaft 10 supported transversely thereof and carrying pairs of spaced sprocket wheels 7 and 8 respectively. Chains 11 reeved around the pairs of sprocket wheels 7 and 8 are equipped with a large number of feed buckets 12 at a specified spacing for receiving the bags 1. The upper shaft 9 is driven by an electric motor 17 via a sprocket wheel 13, chain 14, sprocket wheel 15 and a reduction gear 16. A chute 18 for transferring the bags 1 extends from the path of travel of the elevator 4 at its upper portion and is positioned on one side of the elevator opposite to the feeding chute 5. The lower end of the transfer chute 18 is connected to one side of the starting end of conveyor 19 which is positioned in front of the upper portion of the elevator 4 so as to transfer the bags 1 onto the conveyor 19.

Figure 3:
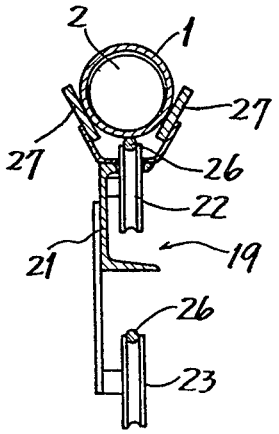
FIG. 3 is a view in section taken along the line III—III in FIG. 1.
Figure 6:
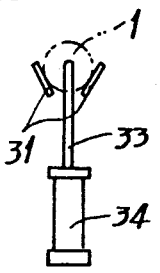
FIG. 6 is a view showing part of FIG. 4 as it is seen in the direction of the arrow line VI—VI in FIG. 4.
Figure 4:
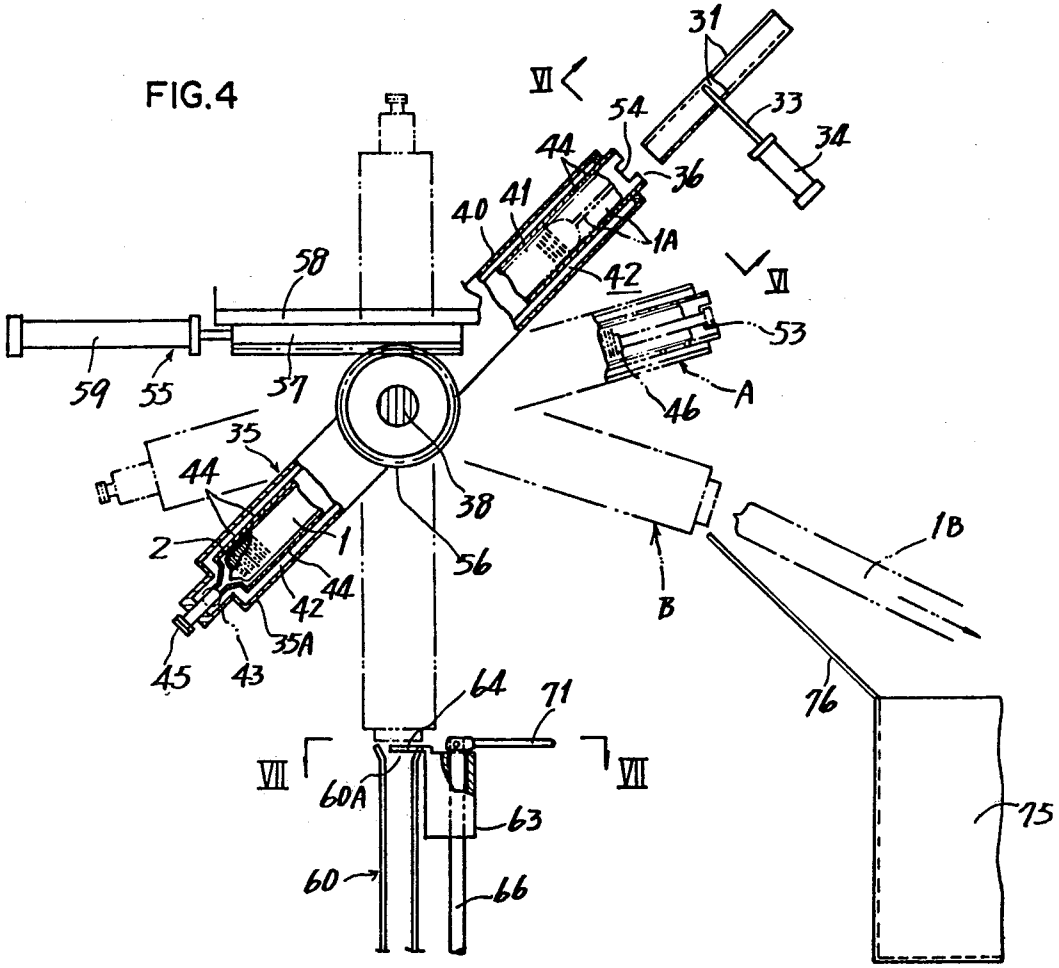
FIG. 4 is a front view partly broken away to show de-bagger means indicated by the arrow IV in FIG. 1.

The conveyor 19 is of the rope conveyor type and extends for example along the ceiling of a building to a location close to a filling chamber 20. As seen in FIGS. 1 and 3, the conveyor 19 comprises a conveyor beam 21 secured to the building, a plurality of guide rollers 22 and return rollers 23 spaced apart as specified, a roller 24 mounted on the frame 6 of the elevator 4, another roller 25 mounted on the housing of the filling chamber 20, a conveyor rope 26 reeved around the rollers, and guide plates 27 provided above the beam 21 on the opposite sides thereof. The roller 25 is driven by an electric motor 28 on the housing through a reduction gear 29, chain 30, etc. The terminal end of the conveyor 19 provides a downwardly curved slanting path. The guide plates 27 are also similarly curved. A slanting feed chute 31 connected to the guide plates 27 are mounted on a frame 32 within the filling chamber 20. FIGS. 1, 4 and 6 show a stopper 33 for the bags 1 which is operable by fluid pressure cylinder means 34 (such as a pneumatic cylinder) mounted on the frame 32. The stopper 33 is positioned close to the terminal end of the chute 31 and extensible into and retractable from the chute 31. The stopper 33 can be dispensed with when the travel of the tubular bags 1 is made controllable by the conveyor 19.

Figure 5:
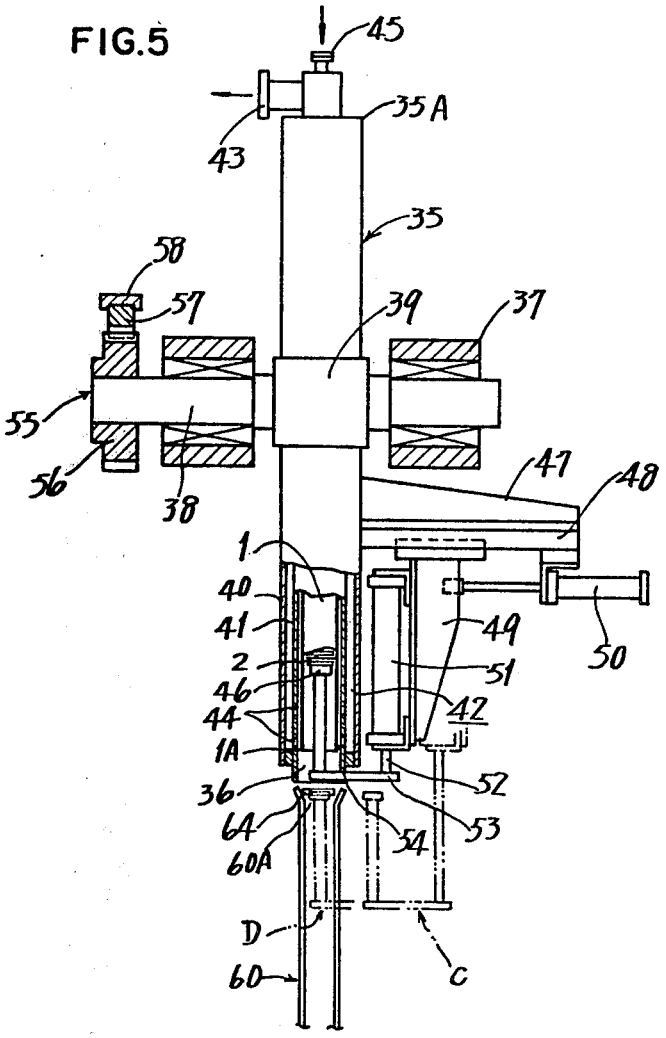
FIG. 5 is a side elevation of FIG. 4 partly broken away.

The elevator 4, conveyor 19 and chute 31 provide conveyor means, by which the bags are sent forward one by one with their folded portions 1A positioned in the rear with respect to the direction of travel. The bags are then transferred from the conveyor means to de-bagger means for taking out the can ends 2 from the bag 1. FIGS. 1, 4 and 5 show in detail an example of the de-bagger means. With reference to these drawings, a de-bagger case 35 has an inlet 36 positioned close to the terminal end of the chute 31 so as to permit the bag 1 to slide into the case 35 under gravity. At a portion of the case 35 closer to its bottom 35A than its midportion, the case 35 is turnably supported by a pin 38 on arms 37 projecting from the frame 32. As seen in FIGS. 4 and 5, the de-bagger case 35 comprises a bottomed outer tube 40 mounted on the pin 38 by a tubular bracket 39 and a bottomed inner tube 41 concentric with the outer tube 40 and connected thereto by suitable members. An annular space 42 is formed between the tubes 40 and 41. The annular space 42 is in communication with an air withdrawing mouth 43 provided at the bottom of the outer tube 42 and also communicates with the interior of the inner tube 41 through ports 44 provided near the bottom 35A of the inner tube 41 and near the inlet 36. The inner tube 42 communicates at its bottom 35A with an air injecting mouth 45 which in turn communicates with suction means (such as a suction pump) which produces suction within the de-bagger case 35. The air injecting mouth 45 is in communication with air injecting means (such as a compressor) which injects air into the de-bagger case 35. The inner tube 41 has an inside diameter slightly greater than the outside diameter of the bag 1 by such an amount that the bag can smoothly slidingly enter the inner tube 41, with the result that the bag 1 will be delivered from the slanting feed chute 31 into the inner tube 41 with its folded portion 1A unfolded by engagement with the top end of the inner tube 41.

A can end retainer 46 is movable on the axis of the de-bagger case 35 into and out of the inner tube 41 and is also movable outside the inner tube 41 between a position on the axis and a position away from the axis. The outer tube 40 is provided with a bracket 47 extending sidewise outwardly therefrom and having a guide 48 integral with the bracket 47. Another bracket 49 guidable by the guide 48 is movable by cylinder means 50. The movable bracket 49 is provided with cylinder means 51 along the above-mentioned axis. The piston rod 52 of the cylinder means 51 has a lateral bar 53 carrying the can end retainer 46 in the form of a rod. According to the structure described, the operation of the cylinder means 51 moves the can end retainer 46 into and out of the inner tube 41, and the cylinder means 50 causes the movable bracket 49 to move the retainer 46 between a position on the axis and another position away from the axis. To prevent the lateral bar 53 from inerfering with a transfer guide (to be described below) when the de-bagger case 35 is brought to its vertical position with its inlet 36 down, the inner tube 41 has a cutout 54 in its edge for receiving the lateral bar 53 therein.

The de-bagger case 35 must be turned from its bag receiving position to its discharge position for permitting the can ends to descend under gravity. For this purpose, there is provided means 55 for turning the de-bagger case 35 through a specified angle to a vertical position in which the inlet 36 is directed downward. The turning means 55 comprises a pinion 56 secured to the pin 38, a rack 57 meshing with the pinion 56, a guide member 58 mounted on the frame 32 for guiding the rack 57, and cylinder means 59 for moving the rack 57. The turning means of the rack-and-pinion type can be replaced by link-type means.

Figure 7:
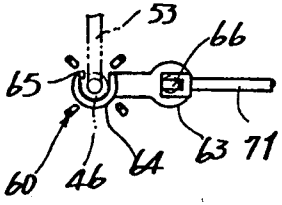
FIG. 7 is a view showing another part of FIG. 4 as it is seen in the direction of the arrow line VII—VII in FIG. 4.

The can ends descending from the interior of the de-bagger case 35 under gravity are led to a seamer 61 by guide means comprising a transfer guide 60 and control means for assuring gentle downward movement of the can ends by supporting the can ends which tend to fall through the guide 60. The transfer guide 60 has an inlet 60A positioned immediately below the de-bagger case 35 when the case is in its vertical position. The guide 60 receives the can ends 2 spontaneously falling from the bag 1 within the de-bagger case 35 and continuously reliably leads the can ends to a feeding duct 62 for the seamer 61. As shown in FIG. 7, the transfer guide 60 comprises four rods. The can end retainer 46 is movable into and out of the guide 60 through a clearance between two rods. The downward movement control means includes a vertically movably member 63 carrying a support piece 64 projecting therefrom into the transfer guide 60 through another clearance adjacent the above clearance. The support piece 64 has a recess 65 for permitting the movement of the can end retainer 46. As shown in FIG. 1, the member 63 is vertically movable by being guided by a post 66 tiltably pivoted at its lower end to the frame 32. The vertically movable member 63 is connected to one end of a rope 69 passed over a pulley 68 and having a counterweight 67 at the other end thereof. The gravity acting on the counterweight 67 at all times acts to position the member 63 at the upper portion of the transfer guide 60. The member 63 is movable downward by the gravity acting on a specified number of can ends 2. Post tilting pneumatic cylinder means 70 pivoted horizontally to the frame 32 has a piston rod 71 whose free end is pivoted to the top end of the post 66. A limit switch 72 mounted on a lower portion of the post 66 on one side thereof functions upon the member 63 reaching the lower limit of its downward travel, actuating the cylinder means 70 to tilt the post 66, whereby the support piece 64 on the movable member 63 is withdrawn from the transfer guide 60. The gravity on the counterweight 67 pulls up the movable member 63. Subsequently, the cylinder means 70 is operated again, bringing the tilted post 66 to its vertical position and placing the support piece 64 into the transfer guide 60 for the support piece to receive the following can ends 2. Indicated at 73 are guide rails for the counterweight 67. An emergency sensor 74 provided at the lower limit position of the support piece 64 on the member 63 is adapted to operate when the feed of the can ends 2 delays greatly, namely upon the uppermost can end passing the level of the sensor 74, emitting a signal to stop the seamer 61, filling machine, etc.

A container 75 receives empty bags 1B released from the de-bagger case 35 via a chute 76.

The feeder operates in the following manner. Tubular bags 1 containing can ends are placed one by one into the chute 5 from the de-palletizer 3. The chute 5 supplies the bags to the elevator 4, from which the bags are rollingly transferred onto the conveyor 19 in such a position that the folded portion 1A of the bag 1 will be positioned in the rear with respect to the direction of advance of the conveyor 19. The bag brought into the slanting feed chute 31 is temporarily halted by the stopper 33. With the retraction of the stopper 33 from the chute 31, the bag 1 is led into the de-bagger case 35 with the folded portion 1A of the bag 1 unfolded to a stretched position by engagement with the inner tube 41. Consequently the bag including the unfolded portion 1A is completely accommodated within the inner tube 41 as indicated in phantom lines in FIG. 4. With the bag so positioned, suction is applied to the case 35 by way of the air withdrawing mouth 43, whereupon the air flowing from the interior of the inner tube 41 through the ports 44 into the annular space 42 produces negative pressure within the inner tube 41, with the result that the bag will be adhered to the inner surface of the inner tube 41 progressively from the bottom 35A toward the inlet. Eventually the unfolded portion 1A will be diametrically expanded and adhered to the inner surface as indicated in solid lines in FIG. 4. While the bag is being subjected to such suction, the cylinder means 59 of the turning means 55 is actuated, causing the rack 57 and pinion 56 to turn the de-bagger case 35 about the axis of the pin 38. During the placement of the bag 1 into the case 35 descriped above, the can end retainer 46 has been at a position away from the axis of the inner tube 41 outside thereof (see the phantom lines C in FIG. 5). During the turn of the de-bagger case 35 about the pin 38, the can end retainer 46 is brought from the above-mentioned position to a position on the axis by the operation of the cylinder means 50. The cylinder means 51 further moves the retainer 46 from outside the inner tube 41 thereinto through the expanded unfolded portion 1A and then into contact with the can end 2 positioned most closely to its opening as indicated in the phantom lines A in FIG. 4. The de-bagger case 35 is halted upon turning to its vertical position in which the inlet 36 is opposed to the inlet 60A of the transfer guide 60 as indicated in solid lines in FIG 5. The cylinder means 51 subsequently actuated withdraws the retainer 46 from the inner tube 41 as indicated in the phantom line D in FIG. 5, allowing the can ends 2 to spontaneously fall independently of the bag 1 onto the support piece 64 on the vertically movable member 63 which piece has already been raised to the inlet of the transfer guide 60. Simultaneously with this, the cylinder means 50 is actuated, bringing the retainer 46 to the position away from the axis as indicated in the phantom lines C in FIG. 5. As a result, the movable member 63 now under the combined weight of the can ends 2 contained in the bag 1 descends along the post 66 against the gravity on the counterweight 67. Before the can ends 2 wholly egress from the de-bagger case 35, the can ends 2 are placed on the stack of can ends 2 previously led into the transfer guide 60, with the support piece 64 positioned between the stacks of can ends. The can ends progressively descends with the feed of can ends to the seamer 61. When the upper stack of the can ends 2 has completely come out of the de-bagger case 35, namely upon the movable member 63 reaching the lower limit of its downward movement, the limit switch 72 functions, emitting a signal to actuate the pneumatic cylinder means 70 which in turn tilts the post 66 and withdraws the support piece 64 from the transfer guide 60. The stack of the can ends 2 supported by the piece 64 now comes into intimate contact with the preceding stack of the can ends 2. The withdrawn movable member 63 is pulled up by the counterweight 67 to its upper limit position and returned by the operation of the cylinder means 70 to its original position ready for the subsequent transfer of can ends 2. When the de-bagger case 35 is brought back to the position B in FIG. 4 during return to its original position, the suction through the air withdrawing mouth 43 is interrupted and air is injected into the de-bagger case 35 through the mouth 45, whereby the empty bag 1B remaining in the case 35 is forced out from the inner tube 41 into the container 75 by way of the chute 76. The de-bagger case 35 from which the empty bag 1B has been removed is returned to its solid-line position in FIG. 1 in condition for receiving the following tubular bag 1. Before the case 35 is brought to this position, the following tubular bag 1 has been sent to the position of the stopper 33. Accordingly, the bag 1 will be placed into the case 35 upon the retraction of the stopper 33, and the same operation as described above will be repeated.

Figure 8:
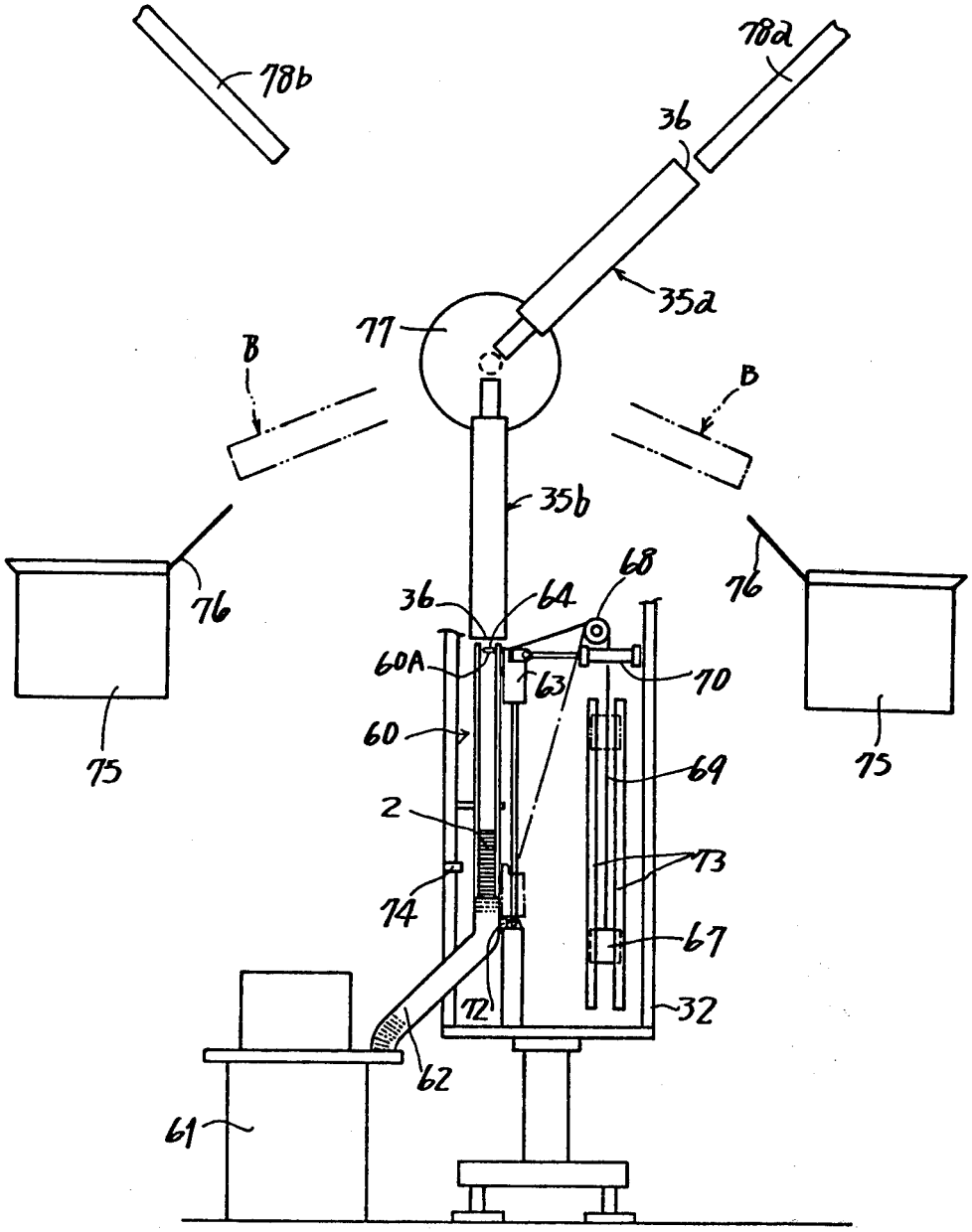
FIG. 8 is a front view showing a second embodiment of this invention.

FIG. 8 schematically shows a second embodiment of this invention having a further improved feeding capacity. If for example the bag contains about 200 can ends whereas the seamer is capable of handling about 1,000 cans per minutes, the first embodiment will have difficulty in catching up with the operation of the seamer. The second embodiment includes a pair of de-bagger cases **35*a* and 35*b* mounted on a turnable disk 77 as arranged radially and angularly spaced apart from each other by 120°. A pair of conveyor means such as feed chutes 78*a* and 78*b* of suitable construction are arranged symmetrically with respect to a vertical line on the axis of rotation of the turnable disk 77 and are each positioned at an angle of 60° with the vertical line. The inlets 36 of the de-bagger cases 35*a* and 35*b* are positionable in opposed relation to the terminal ends of the feed chutes 78*a* and 78*b* respectively and also to the inlet 60A of the guide 60. Accordingly, when the turnable disk 77 is turned reversely every 120°, the de-bagger cases 35*a* and 35*b* are alternatively turnable between a receiving position in which the inlet 36 of one of the cases is opposed to the feed chute 78*a* or 78*b* and a discharge position in which the inlet 36 of the other case is opposed to the guide 60. This renders two de-bagger cases 35***a* and 35*b* alternately connectable to one guide 60 to smoothly feed can ends to a seamer of increased capacity in accordance with the capacity.

Although the two de-bagger cases can be alternatively turnable between the receiving position and the discharge position most simply by the use of a turnable disk carrying the cases as described above, the de-bagger cases are similarly turnable respectively by separate drive means which are operated in timed relation to each other.

What is claimed is:

1. A can end feeder including at least one conveyor means for feeding one by one bags each containing a stack of can ends, de-bagger means having at least one de-bagger case and bag opening means, the de-bagger case being turnable between a receiving position for receiving the bag from the conveyor means and a discharge position in which the case has its opening directed downward to render the can ends within the bag downwardly movable by gravity, and guide means for guiding the can ends to a seamer when the can ends fall from the bag within the case, the improvement comprising:

the bags each having an open end closed by being folded and feedable with the folded portion positioned in the rear with respect to the direction of travel of the bags, the case having an inside diameter greater than the outside diameter of the bag by an amount permitting the bag to be smoothly placed therein, the case being provided with suction means for at least partially adhering the bag therein to its inner wall, and the case being provided with means for discharging the bag therefrom.

2. A can end feeder as defined in claim 1 wherein the suction means is disposed near the opening of the case and near the bottom thereof.

3. A can end feeder as defined in claim 1 wherein the case comprises a bottomed inner tube for containing the bag and an outer tube surrounding the inner tube with an annular space formed therebetween, the inner tube being provided at least near a bag receiving opening thereof with ports for maintaining the interior of the inner tube in communication with the annular space, the annular space being in communication with sucking means.

4. A can end feeder as defined in claim 3 wherein ports for maintaining the interior of the inner tube in communication with the annular space are provided near the opening of the inner tube and near the bottom thereof.

5. A can end feeder as defined in claim 1 wherein the bag discharging means comprises a pressure fluid injecting mouth provided at the bottom of the case.

6. A can end feeder as defined in claim 1 wherein the case is provided with a can end retainer for holding the bagged can ends in position within the case by contact with the bagged can end closest to the opening, the retainer being movable toward the open end of the case after the case has been brought to its discharge position and retractable sidewise after delivering the can ends to the guide means.

7. A can end feeder as defined in claim 6 wherein the case is provided on one side thereof with cylinder means parallel to the axis of the case and movable toward or away from the axis, the cylinder means having a piston rod carrying on its free end a lateral bar extending toward the case axis, the can end retainer being mounted on the forward end of the lateral bar and extending along the case axis, the case being formed in its open end with a cutout for receiving the lateral bar therein.

8. A can end feeder as defined in claim 1 wherein a pair of de-bagger cases are disposed radially on the same plane intersecting the axis of rotation of the cases at right angles thereto, the de-bagger cases being provided with means for alternatively turning the cases between the receiving position and the discharge position and with a pair of conveyor means for the de-bagger cases in the receiving position.

* * * * *